United States Patent [19]

Woodruff

[11] 4,089,498

[45] May 16, 1978

[54] 12 HOUR COASTER

[76] Inventor: George N. Woodruff, Box 517, Rte. 3, Merritt Island, Fla. 32952

[21] Appl. No.: 769,789

[22] Filed: Feb. 17, 1977

[51] Int. Cl.[2] ..... A47G 29/02

[52] U.S. Cl. ..... 248/346.1

[58] Field of Search ..... 248/346.1, 346

[56] References Cited

U.S. PATENT DOCUMENTS

| | | | |
|---|---|---|---|
| 2,118,326 | 5/1938 | Richardson | 248/346.1 |
| 2,652,703 | 9/1953 | Keegan | 248/346.1 |
| 2,688,858 | 9/1954 | Cosmetto | 248/346.1 |
| 2,709,905 | 6/1955 | Dunlap | 248/346.1 |
| 3,808,084 | 4/1974 | Doty | 248/346.1 |
| 3,836,416 | 9/1974 | Ropiequet | 248/346.1 |

FOREIGN PATENT DOCUMENTS

| | | | |
|---|---|---|---|
| 432,746 | 9/1967 | Switzerland | 248/346.1 |

*Primary Examiner*—Marion Parsons, Jr.
*Attorney, Agent, or Firm*—Alfred B. Levine

[57] ABSTRACT

A coaster for containers of hot or cold liquids that more effectively insulates the container from both the outer walls and base of the coaster, and that does so for longer periods of time of continuous use than known devices. Among other features, the coaster impedes the formation of condensate water on its outside walls and base, and provides an improved non-adhering adsorbent layer to receive and contain the container and receive the condensate drained from its walls.

7 Claims, 4 Drawing Figures

12 HOUR COASTER

STATEMENT OF THE INVENTION AND BACKGROUND

This invention relates to coasters for holding glasses and other containers for hot and cold beverages, and more particularly to such coasters that are more effective for longer periods of time than those presently available.

Glasses and containers having cold beverages collect condensate on their outside surfaces that runs down the side of the container into the coaster or onto the furniture, or alternatively, drips from the container onto the clothes of the person lifting the container to drink. Where a cold beverage container is placed on a warmer furniture surface, the cooling of the furniture surface by the container deposits condensate from the surrounding air directly onto the surface. Where the cup or glass containing a hot beverage is placed on a cooler surface, such as furniture, the steam or condensate from the warm container is deposited directly on the furniture.

When using conventionally made coasters in an effort to collect the moisture and protect the user and the furniture, the well of the coaster progressively fills with condensed water about the base of the glass as condensate continuously forms and drips from the glass walls. This collected condensate is cold, and is maintained in its cold condition by contact with the bottom of the glass that contains melting ice cubes. Therefore the coaster itself becomes a container of cold liquid, much as the glass it is holding, and heat is therefore transferred from the furniture supporting the coaster and from the ambient air surrounding the coaster to the base and sides of the coaster. When the outside surfaces of the coaster have become chilled below the dew point of the surrounding air, moisture condenses on the surface of the coaster and drips onto the furniture. Additionally, heat is removed from the surface of the furniture itself through the base of the coaster until it also becomes chilled below the dew point, causing direct condensation onto the surface of the furniture. These conditions are experienced in almost all climates and environments, but are, of course, much more pronounced and intensified in warm, humid environments, such as are found in tropical southern regions.

An additional difficulty experienced with conventional coasters is in the base pad that is usually made of sponge, cork, plastic or fabric material and is usually disposed inside the well of the coaster to receive the bottom of the glass and collect the condensate dripping from its walls. Quite often as this base material becomes wet, a cohesive bond is formed between it and the base of the glass, resulting in the coaster or its base pad sticking to the glass as the glass is raised to drinking position. Often this temporary bond is broken as the glass is raised whereupon the coaster or its base pad then drops onto the table or onto the lap of the drinker. In some instances, this base pad or insert in the coaster is made with an uneven surface, having ridges, napped piles of fibres, or other protuberances, all of which tend to tilt and sometimes spill glasses having small bases. In other instances, the absorption of condensed water by the base pad results in unequal expansion or swelling of the pad, again resulting in the glass being tilted or its contents being spilled.

SUMMARY OF THE INVENTION

According to the present invention there is provided an improved coaster that corrects for many of these difficulties of prior art devices. In a preferred construction, the coaster is provided with a more effectively isolated recessed well region to receive the glass or cup that is more efficiently insulated from both the outside walls of the coaster and the base of the coaster. This insures that heat or cold from the well region is not transferred to or from the furniture to the outside of the coaster, and accordingly it reduces the condensation both on the furniture itself and that dripping on the furniture from the coaster.

Additionally, the coaster is provided with a removable base or pad insert disposed inside of the well that is adsorbent rather absorbent of condensed moisture. This base pad is provided with a non-slip felt-like surface to support the base of the glass but does not adhere to the base as in many prior art pads. Being adsorbent rather than absorbent, it does not expand or swell as condensate water is collected in the well since the individual fibres do not absorb any moisture. This insures that its surface remains even and level despite the introduction of a considerable quantity of condensate water over a period of time. In this preferred construction, the base is also removable from the coaster permitting it to be quickly drained and dried or washed.

In this preferred construction the coaster can be used in hot humid climates continuously for long periods of time with repeated refills of the glass with liquid and ice, yet continuously protects the furniture surface and the user from deposited moisture and condensate in a manner superior to available devices, and does not stick or adhere to the glass.

DETAILED DESCRIPTION OF PREFERRED EMBODIMENT

Figure 1:
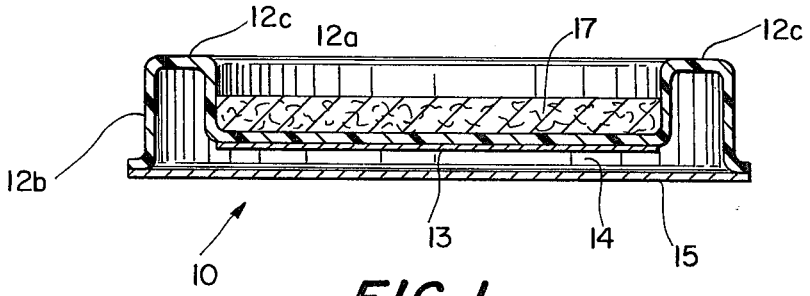
FIG. 1 is a cross-sectional view of one preferred embodiment of the invention.

Referring to FIG. 1, the preferred construction shown comprises a thin walled coaster 10 of insulating, non-warpable, plastic material that may be vacuum formed of a thin polystyrene sheet having a thickness of 0.030 thousandths of an inch.

The coaster is shaped as shown to provide a depressed central circular well portion 11, having a diameter greater than that of the largest glass or cup it is adapted to accomodate, and an upstanding annular rim portion 12 disposed about the central well to accomodate the glass or container (not shown) in its normal upright position. As is shown, the annular rim portion 12 is formed with an inside wall **12*a* and outside wall 12*b* that are spaced apart from each other for a considerable distance, of ⅜ inch or greater, to provide a general rectangularly shaped configuration. This widely separated spacing of the inner and outer walls 12*a* and 12*b* is provided to form a more effective thermal insulation space between the two walls. The relatively flat annular connecting portion 12*c* disposed between the inside and outside walls is relatively long and is constructed of the thin polystyrene material described above. It therefore provides a poor thermal conductor between the inner and outer walls to effectively isolate and insulate the well region 11 from the outside wall 12***b*.

Underneath the coaster 10 and below the central well region 11 is provided an aluminium foil reflecting insulator layer 13 whose purpose is to reflect heat back to the supporting surface. This layer 13 assists in preventing heat transfer between the well region 11 and the furniture surface (not shown) that supports the coaster.

As shown, the outside wall portion 12*b* extends downwardly, beyond the depth of inside wall 12*a* to raise the well portion 11 above the furniture supporting surface and therefore provides a thermal insulating space 14 between the well region 11 and the furniture. After long term use of the coaster with repeated cold drinks, some condensation forms on the underside layer 13 of the coaster beneath the well region but does not accumulate in sufficient quantity to fall. However, to prevent dripping of any such condensate onto a table or support, the underside of the coaster is preferably enclosed by a circular lower cover 15 that is suitably fastened at its periphery to the circular bottom edge of the outside wall 12*b*. In this manner, the insulation space 14 between the well 11 and the table or support is entirely closed and any moisture or condensate forming on the underside of the well 11 cannot drip onto the table or clothing of the drinker.

Figure 2:
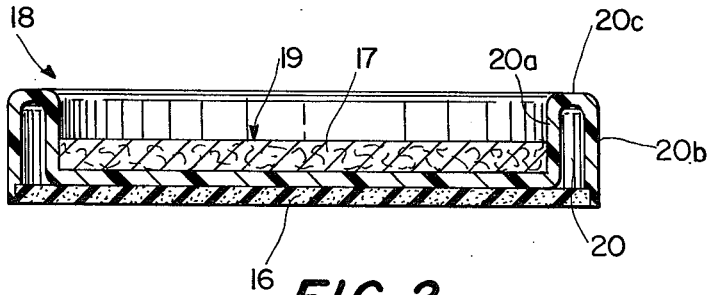
FIG. 2 is a cross-sectional view similar to FIG. 1 and showing an alternative embodiment.

Instead of closing the underside of the coaster 10 with a cover 15, or in addition to such closure, this space may be filled with a suitable insulation material 16, as shown in FIG. 2. A suitable insulation material for this purpose is closed cell polyurethane foam that provides an additional desirable feature of supplying a non-skid relatively soft under surface that impedes sliding of the coaster on furniture thereby minimizing the danger of spilling of the liquid from the glass.

In this preferred construction, a frictionally held removable pad or base disc 17 of felt-like material is provided inside the well to supply a non-slip surface for receiving the base of the glass. This pad 17 is formed of an adsorbent, rather than absorbent material, so as not to swell or change its structural shape as condensate collects in the well, and not to adhere to the base of the glass. A preferred material for this purpose is polypropylene olefin felt, obtainable in a thin felt layer form similar to that presently employed for "indoor—outdoor" carpeting. This material has a felt-like fibrous surface that removes water from the bottom of the glass. However the fibres of pad 17 do not absorb the water. Moreover such material is also resistant to alcohol and is washable, and does not adhere to the glass regardless of the quantity of water collected in the well.

In an alternate embodiment of FIG. 2, the coaster body 18 is constructed of a sheet of thicker plastic material, approximately ⅛ inch thick having good thermal insulation properties, such as melamine, that may be injection molded or cast in generally similar shape as in FIG. 1. Like the embodiment of FIG. 1, the well portion 19 is raised above the furniture surface to provide a thermal isolation space below the well. A thin reflecting foil layer 20 is also preferably provided underneath the well 19, and the remaining space is filled with an insulation layer 16 of closed cell polyethylene foam or the like, as described above.

Between the inner and outer side walls 20*a* and 20*b*, respectively, an insulating air space is provided, and the flat annular portion 20*c* connecting these walls provides a poor thermal conductor. As a result, the well portion 19 in FIG. 2, like that of FIG. 1, is quite effectively insulated from both the outside wall 20*b* of the coaster as well as from the furniture surface (not shown) supporting the coaster.

As generally discussed above, during continued use of the coaster for long periods of time was might be occasioned by a series of refills of the glass with liquid and ice, a considerable quantity of condensate water is collected in the well. Being in contact with the ice filled glass, this condensate is often cooled to a temperature close to 32° F, and therefore provides a low temperature body of water in proximity to the outside walls of a coaster and to its underside supporting surface, such as a furniture table top (not shown). According to the present invention, heat transfer to and from these surfaces is impeded by the novel construction of the inside and outside side walls; and by the insulation of the well from its support base by means of a reflecting layer, and an insulation layer of air (FIG. 1) or foam insulation or the like (FIG. 2).

Additionally, an adsorbent pad or base rather than a conventional absorbent material is employed to effectively remove condensate water from the glass yet maintain a condition of non-adhesion to the glass. Furthermore this adsorbent pad does not expand or swell or otherwise appreciably change its structural shape or volumetric configuration as quantities of water are collected in the well region with long term continuous use of the coaster.

Figure 3:
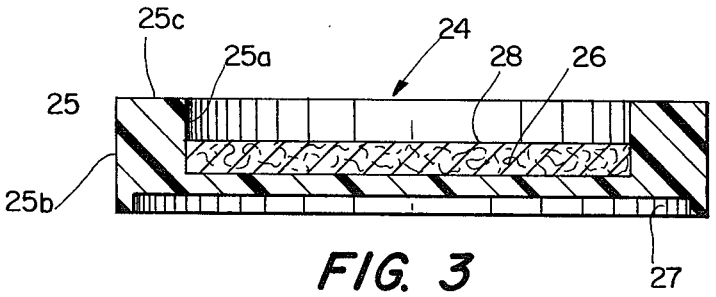
FIG. 3 is a similar view illustrating a still further embodiment of the invention.
Figure 4:
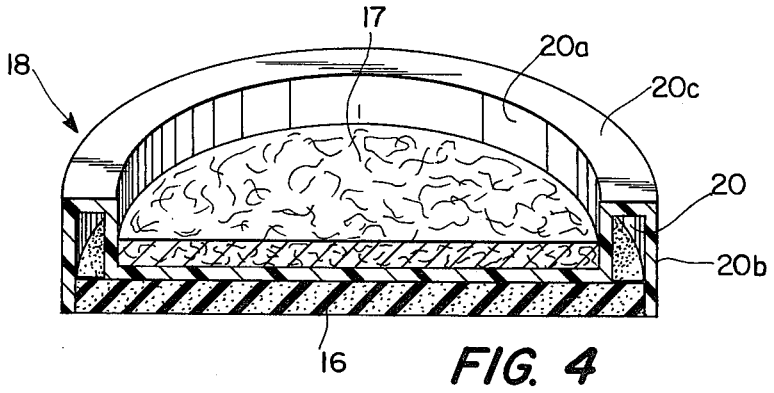

In the alternative construction of FIG. 3, the coaster 24 is formed with a solid rim 25 encircling the well 26 instead of the inverted U-shaped hollow rim as is provided in FIGS. 1 and 2. The inner wall 25*a* and outer wall 25*b* are disposed vertically, or substantially so, as shown, and the rim 25*c* is of substantial thickness and of suitable insulating material to provide good thermal insulation between the inner and outer walls 25*a* and 25*b*, respectively.

A space 27 is provided underneath the well portion 26, to provide thermal insulation underneath the well 26, as previously described. As in the embodiments of FIGS. 1 and 2, a layer of reflecting foil, or the like, (not shown) may be provided underneath the well 26, and the remaining space 26 may be filled with a closed cell polyurethane foam (not shown) for further insulation and to provide a non-skid lower surface.

Inside the well 26 is provided a layer of adsorbent material 28, such as polypropylene olefin felt, as previously described, to provide a suitable surface for receiving and accomodating a glass and receiving its condensed water.

As will be appreciated by those skilled in the art, many changes may be made without departing from the spirit and scope of this invention. For example, in the thin-walled construction of the coaster of FIG. 1, the material used may be made of thin sheet metal, instead of plastic.

However, for a metal coaster, the well portion 17 is preferably made deeper, and is raised upwardly further from the outside base 15 than in the embodiment of FIG. 1. Additionally, it is preferred that the annular rim portion 12*c*, interconnecting walls 12*a* and 12*b* be made longer or otherwise constructed as to provide a poor thermal path between these walls. Still further, a layer of insulation (not shown) would preferably be employed completely underneath the bottom edge of the outside wall 12*b*.

It will also be appreciated by those skilled in the art, that the annular rim portion 12c in FIG. 1, 20c in FIG. 2, and 25c and FIG. 3, may be inclined inwardly toward the well, thereby to drain any condensed water forming thereon into the well. Since these and many other changes may be made without departing from the spirit and scope of this invention, this invention is to be considered as limited only by the following claims.

What is claimed is:

1. A long term coaster for removing and containing the condensate formed on the outside of glasses containing iced beverages and preventing condensate from forming on the furniture underneath the coaster or on the outside walls of the coaster itself and subsequently dripping onto the furniture comprising:

a body of liquid impervious non-warpable material having a liquid impervious central well portion encircled by an uninterrupted upstanding wall portion, the central well portion being elevated above and out of contact with any supporting surface, providing a thermal insulation region underneath the well portion, said encircling wall portion including an inside wall in communication with the well portion and an outside wall portion that is disposed to provide poor thermal connection to the inside wall, an adsorbent pad of material disposed inside the well portion, that is substantially non-wettable by the condensate, substantially non-adherent to a glass or container surface whether the well contains condensate fluid or not, and substantially invarient in surface configuration and volumetric content as the well fills with condensate, said well portion and side wall portions being integrally formed of plastic material, with said inner and outer wall portions being spaced apart from one another for a distance sufficient to prevent condensate forming on the outside wall portion, and vapor impermeable means disposed beneath the well for preventing the deposit of moisture on a supporting surface beneath the coaster.

2. In the coaster of claim 1, said material comprising an integral member of plastic, formed with a depressed central circular well region and an upstanding annular rim having a substantially inverted U-shaped cross section, with the outside wall portion extending beyond the length of the surface supporting the coaster and provide an insulative space underneath the well portion.

3. In the coaster of claim 2, a thin layer of heat reflective material disposed underneath the well portion.

4. In the coaster of claim 2, said vapor impermeable means including thermal insulation impervious to moisture disposed underneath the well portion, to provide further thermal insulation between the well portion and any supporting surface for the coaster.

5. In the coaster of claim 4, said insulation including a heat reflecting layer and a layer of closed cell polyethylene foam.

6. In the coaster of claim 2, said vapor impermeable means including a closure member disposed underneath the well portion and attached near its periphery to the edge of the outer wall, said closure member enclosing the space beneath said well portion.

7. In the coaster of claim 6, said thermal insulation including a layer of heat reflective material and a poor heat conductive material.

* * * * *